US011573064B1

(12) United States Patent
Siepman et al.

(10) Patent No.: US 11,573,064 B1
(45) Date of Patent: Feb. 7, 2023

(54) PISTOL CONVERSION KIT

(71) Applicants: Dustin Siepman, Boynton Beach, FL (US); Jacob Adams, Pompano Beach, FL (US)

(72) Inventors: Dustin Siepman, Boynton Beach, FL (US); Jacob Adams, Pompano Beach, FL (US)

( * ) Notice: Subject to any disclaimer, the term of this patent is extended or adjusted under 35 U.S.C. 154(b) by 0 days.

(21) Appl. No.: 17/578,363

(22) Filed: Jan. 18, 2022

(51) Int. Cl.
*F41C 23/12* (2006.01)
*F41C 3/00* (2006.01)
*F41A 21/48* (2006.01)

(52) U.S. Cl.
CPC ..... *F41C 23/12* (2013.01); *F41A 21/488* (2013.01); *F41C 3/00* (2013.01)

(58) Field of Classification Search
CPC ..... F41C 23/12; F41A 11/00; F41A 11/02; F41A 11/04
See application file for complete search history.

(56) References Cited

U.S. PATENT DOCUMENTS 4,601,123 A * 7/1986 Swearengen ..... F41A 11/02 42/74
7,448,307 B1 * 11/2008 Dafinov ..... F41A 5/26 89/191.01
8,615,915 B2 * 12/2013 Hunter ..... F41C 23/16 42/72
10,161,709 B1 * 12/2018 Wright ..... F41C 7/00
10,545,006 B1 * 1/2020 Zhang ..... F41C 23/12
11,306,986 B1 * 4/2022 Titus ..... F41A 19/35
11,326,845 B2 * 5/2022 Muska ..... F41C 7/025
2011/0088305 A1 * 4/2011 Oz ..... F41C 23/12 42/69.01
2014/0075812 A1 * 3/2014 Johnson ..... F41A 19/08 42/69.01
2014/0144061 A1 * 5/2014 Bosco ..... F41C 23/10 42/94
2016/0146558 A1 * 5/2016 Kada ..... F41A 3/56 42/16
2017/0131051 A1 * 5/2017 Albury ..... F41C 23/20
2019/0128639 A1 * 5/2019 Parker ..... F41C 23/14

* cited by examiner

*Primary Examiner* — Derrick R Morgan
(74) *Attorney, Agent, or Firm* — The Rapacke Law Group P.A.

(57) ABSTRACT

A pistol conversion kit may be constructed and arranged for converting a pistol to a bull-pup format rifle by attaching an elongated barrel to the pistol. The pistol conversion kit may include a two-part chassis defining a compartment into which the pistol and elongated barrel may be seated behind a handle and trigger guard integrated within the chassis such that the pistol is located behind the pistol conversion kit trigger thereby positioning the pistol in a bull-pup configuration within the chassis. The pistol conversion kit may include a number of sub-assemblies for operating the pistol seated within the chassis and may further include a barrel safety system arranged for preventing use of the pistol conversion kit trigger unless a properly sized elongation barrel is attached to the pistol.

20 Claims, 5 Drawing Sheets

PISTOL CONVERSION KIT

TECHNICAL FIELD

The embodiments generally relate to pistol carbine conversion kits.

BACKGROUND

This disclosure provides the advantages of a conversion kit to enable a pistol carbine to be modified into a bull-pup format that is shorter, more compact, lighter, easier to carry, and ultimately appealing to a user without sacrificing barrel and trigger safety, in contrast to the conventional art.

SUMMARY

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The present disclosure relates generally to a kit which converts a pistol to a bull-pup format rifle by replacing the standard barrel with an elongated barrel. During assembly, the elongated barrel pistol is inserted into a plastic chassis, a gun door is closed, and the rifle is ready to shoot. The kit may include accessories such as modular lock pistol rail interface systems and fasteners and picatinny rails for user customization including adding flashlights, lasers, thumb rests, and the like.

The kit may include a barrel safety mechanism which locks the trigger until the elongated barrel passes through the plastic chassis, wherein in the bull-pup format, the lower frame of the pistol is behind the pistol grip and trigger to avoid a scenario where a bullet will pass over the user's hand on the foregrip and hand on the pistol grip, as is known in the conventional art. The kit provides a trigger linkage such that the pistol may be fired inside the plastic chassis and may include a hinged stock, telescoping stock, slidable stock, or gun door.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
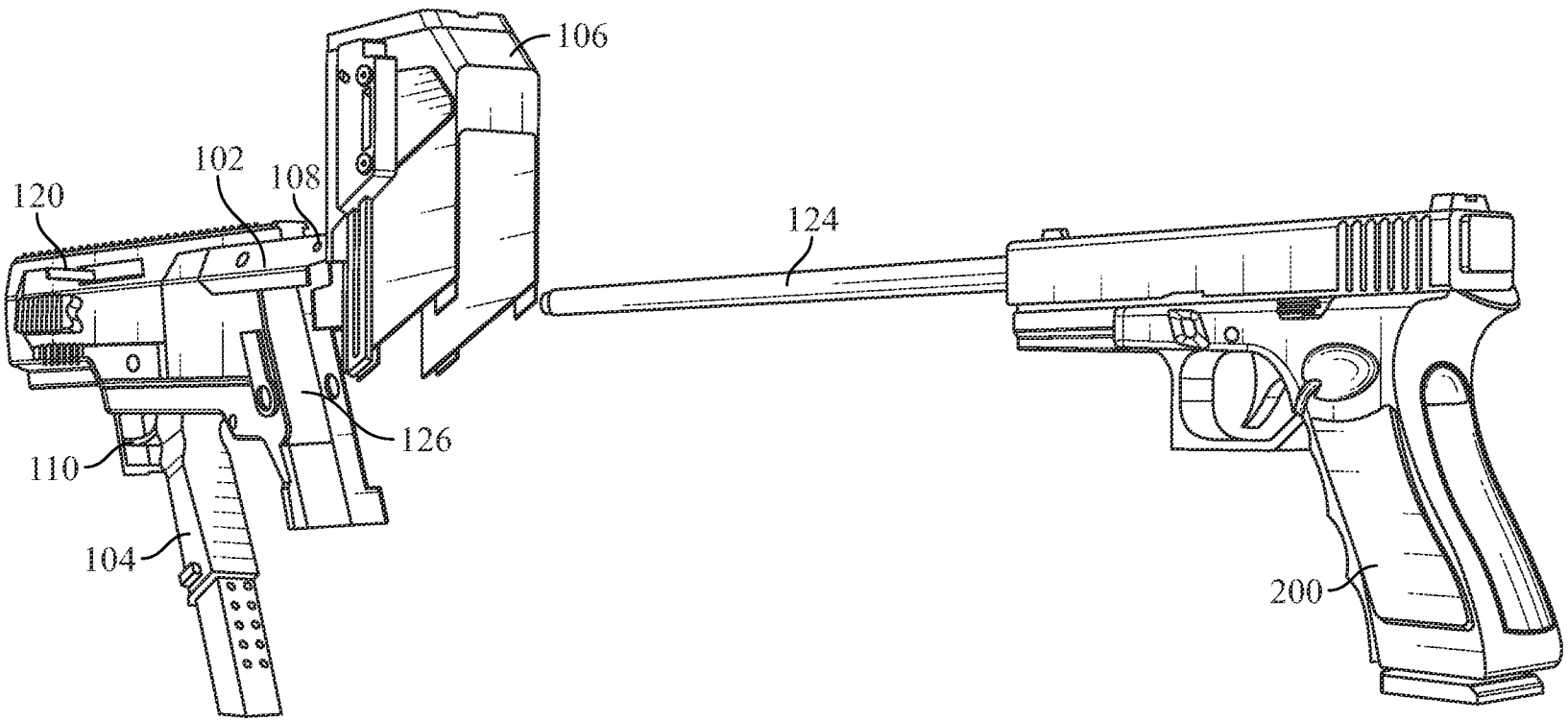
FIG. 1 illustrates a perspective view of a pistol conversion kit according to some variations described herein.

The specific details of the single embodiment or variety of embodiments described herein are to the described system and methods of use. Any specific details of the embodiments are used for demonstration purposes only and no unnecessary limitations or inferences are to be understood from there.

It is noted that the embodiments reside primarily in combinations of components and procedures related to the system. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

A pistol conversion kit may be constructed and arranged to convert a pistol into a rifle in a bull-pup format. The pistol conversion kit may include a chassis, such as a polymer chassis, and an extension barrel constructed and arranged to be attached to a muzzle of a pistol in order to extend the barrel of the pistol. According to some embodiments, the extension barrel may replace the barrel of the pistol entirely. The pistol and extension barrel assembly may be inserted into the chassis and may be secured within the chassis via a gun door. The gun door may be hingedly or slidably attached to the chassis and may hinge into an open position to allow insertion of a pistol and extension barrel and may hinge into a closed position thereby securing the extension barrel and pistol within the chassis. According to some variations, the gun door may firmly abut the frame of a pistol such that the pistol is secured within the chassis. The chassis may include an integrated handle and trigger guard. The chassis may define at least one compartment therein constructed and arranged for receiving a pistol and extension barrel and allowing a portion of the extension barrel to extend therethrough and out of a front of the compartment and chassis. The chassis may be constructed and arranged to securely seat the frame of a pistol therein while allowing a slide of a pistol to travel within the compartment during discharge of the pistol. The frame of the pistol may be firmly seated within the compartment. The compartment may be constructed and arranged to receive a number of components and assemblies associated with the pistol conversion kit including, but not limited to, a trigger assembly, a charging handle assembly, a barrel safety assembly, and various other components.

A trigger assembly may be at least partially disposed within the compartment near the integrated handle and trigger guard of the chassis. The trigger assembly may be constructed and arranged to mechanically engage with a trigger of the pistol such that when the trigger assembly is used, a user may operate the trigger of the pistol via the trigger assembly of the pistol conversion kit. The trigger assembly may be further constructed and arranged to effectively relocate the trigger action of the pistol forward from the actual pistol trigger thereby effectuating a bull-pup arrangement wherein the action of a pistol and magazine of a pistol are located approximately behind a trigger or trigger assembly.

A charging handle assembly may be at least partially disposed within the compartment and may be constructed and arranged to mechanically engage with the slide of a pistol such that when the charging handle assembly is used, a user may operate the slide of a pistol via the charging handle assembly of the pistol conversion kit.

A barrel safety assembly may be at least partially disposed within the compartment and may be in operable communication with the trigger assembly and extension barrel. The barrel safety assembly may prevent the user from pulling the trigger of the trigger assembly unless the barrel safety is moved via inserting the extension barrel of an appropriate length. The insertion of the extension barrel into the chassis may come into operable connection with the barrel safety assembly and rotate the barrel safety within the chassis and away from the trigger assembly. If the extension barrel is not properly inserted within the chassis, or an extension barrel is used that is too short to engage the safety, or no extension barrel is used at all, the barrel safety assembly may bias the barrel safety towards the trigger assembly via a linkage stop and lock the trigger in place thereby preventing use of the pistol conversion kit without an appropriately sized extension barrel. The base of the barrel safety assembly may include a boss constructed and arranged to engage with a complementary trigger linkage boss such that when no extension barrel is present within the chassis, the barrel safety boss and trigger linkage boss are engaged to prevent the trigger within the trigger assembly from being pulled.

The pistol conversion kit may further include a push button thumb safety assembly constructed arrange to interfere with the trigger assembly to prevent squeezing of the trigger when the push button thumb safety assembly is engaged.

The pistol conversion kit may further include an adjustable stock incorporating within the gun door constructed and arranged to extend or elongate for user comfort. The adjustable stock may include an integrated including user shoulder and cheek rests.

Figure 2:
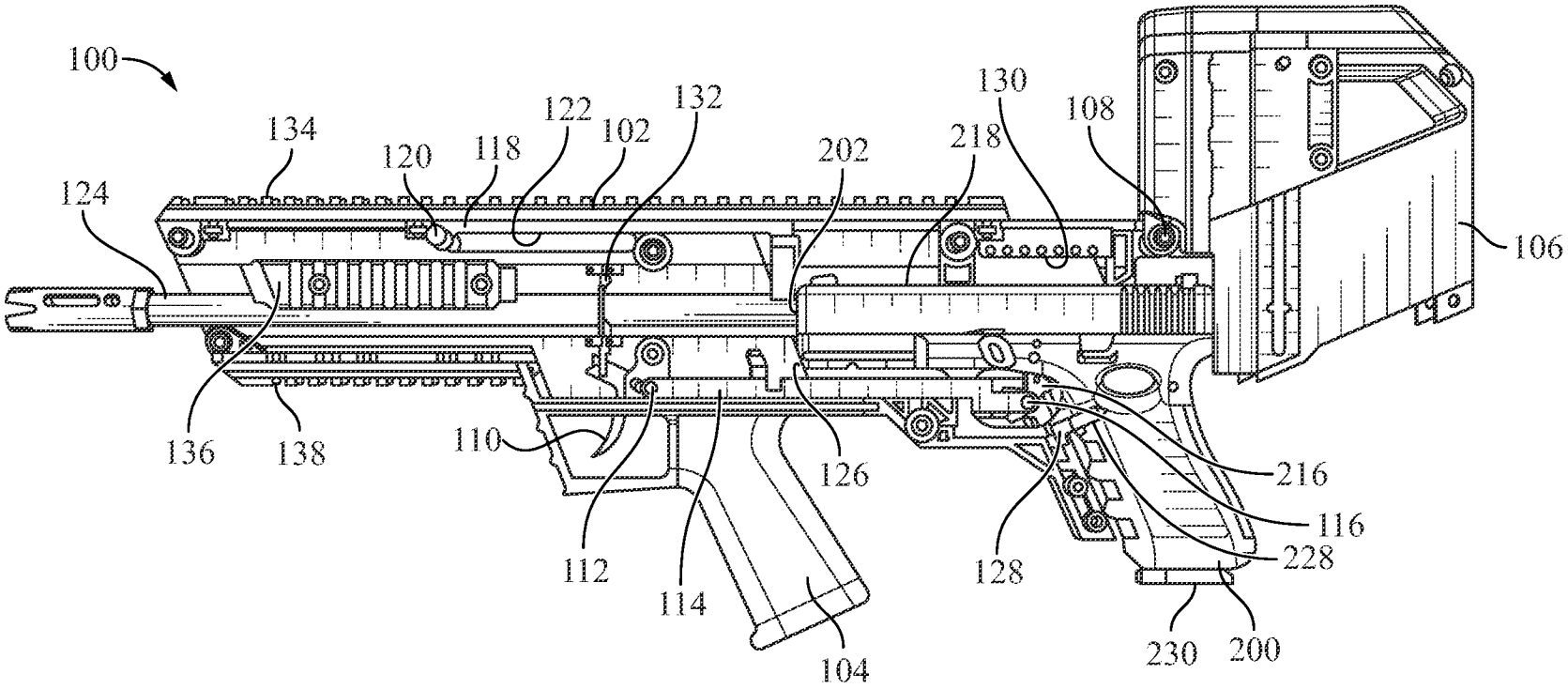
FIG. 2 illustrates a partial cross-sectional view of a pistol conversion kit according to some variations described herein.

FIG. 1 depicts perspective view of a pistol conversion kit including a chassis 102 hingedly or slidably attached to a gun door 106, via a stock hinge 108. The chassis 102 may include a grip 104 including a trigger guard integrated therein, and a trigger 110. The chassis 102 may further include a charging handle assembly including a charging handle 120. The chassis 102 may define a compartment 126 into which a pistol 200, such as a semi-automatic pistol, may be seated such that the chassis 102 houses at least a portion of a pistol 200 therein. An extension barrel 124 may be attached to a pistol 200 and the extension barrel 124 and pistol 200 may be seated within the chassis 102. A trigger assembly, including the trigger 110, may be constructed and arranged to mechanically communicate with a trigger of the pistol 200. The charging handle assembly including charging handle 120 may be constructed and arranged to mechanically communicate with a slide of the pistol 200 such that the charging handle assembly may be used to force the slide of the pistol 200 to be drawn back, thereby arming the pistol 200. The chassis 102 may be constructed and arranged to house the pistol 200 behind the grip 104 such that the pistol 200 is positioned in a bull-pup format within the pistol conversion kit. The chassis may include an integrated handle and trigger guard located in front of a portion of the compartment into which the frame of a pistol may be securely seated, as depicted in FIGS. 1 and 2. The gun door 106 may be constructed and arranged to hingedly or slidably attached to the chassis 102 and swing into a locked position such that the pistol 200 is secured within the chassis 102.

FIG. 2 illustrates a partial cross-sectional view of a pistol conversion kit 100 including a chassis 102 hingedly or slidably attached to a gun door 106, via stock hinge 108. An extension barrel 124 may be attached to the pistol muzzle 202. According to some embodiments, the extension barrel 124 may replace the barrel of the pistol. The chassis 102 may define a compartment 126 into which a pistol 200 may be seated into which an extension barrel 124 may be seated such that the chassis 102 houses at least a portion of a pistol 200 therein. The chassis 102 may define in ejection port 130 constructed and arranged to allow the pistol 200 to eject spent shells from the chassis 102 when the pistol 200 is discharged.

The pistol conversion kit 100 may include a charging assembly including at least one charging handle 120 at least partially disposed within a charging handle channel 122 defined by the chassis 102 and being in operable communication with the charging handle arm 118 constructed and arranged to mechanically engage with a slide 218 of the pistol 200. The charging assembly may include a biasing mechanism to bias the at least one charging handle arm 118 and at least one charging handle 120 forward within the chassis 102. The charging assembly may further include a setscrew insert to decrease the amount of travel of the charging handle in use.

The pistol conversion kit 100 may further include a trigger assembly including a trigger 110 hingedly or slidably attached 112 to and in operable communication with a trigger linkage arm 114 connected to a trigger pin 116 constructed and arranged to be in mechanical communication with a pistol trigger 216 of the pistol 200. In this way, and operator may squeeze the trigger 110 which may in turn translate the trigger linkage arm 114 and trigger pin 116 towards the pistol trigger 216 in order to discharge the pistol 200.

At least a portion of the trigger linkage arm or trigger 110 may be in operable communication with a barrel safety assembly 132. At least a portion of the barrel safety assembly 132 may be in operable communication with the extension barrel 124 such that a pistol 200 disposed within the pistol conversion kit 100 must have the extension barrel 124 attached thereto in order to successfully operate the pistol 200 and pistol conversion kit 100. The barrel safety assembly 132 may be constructed and arranged to lock the trigger 110 in place and prevent squeezing of the trigger 110 unless the extension barrel 124 is passed through at least a portion of the barrel safety assembly 132.

The pistol conversion kit 100 may include a magazine release button 128 integrated with the chassis 102 and being constructed and arranged to depress a pistol magazine release button 228 on the pistol, such that when a user depresses the magazine release button 128, the pistol magazine release button 228 is also depressed thereby releasing a magazine 230 from the pistol 200.

The pistol conversion kit 100 may include at least one rail disposed thereon and may include a top rail 134, a first side rail 136 or second side rail 136, and bottom rail 138.

Figure 3:
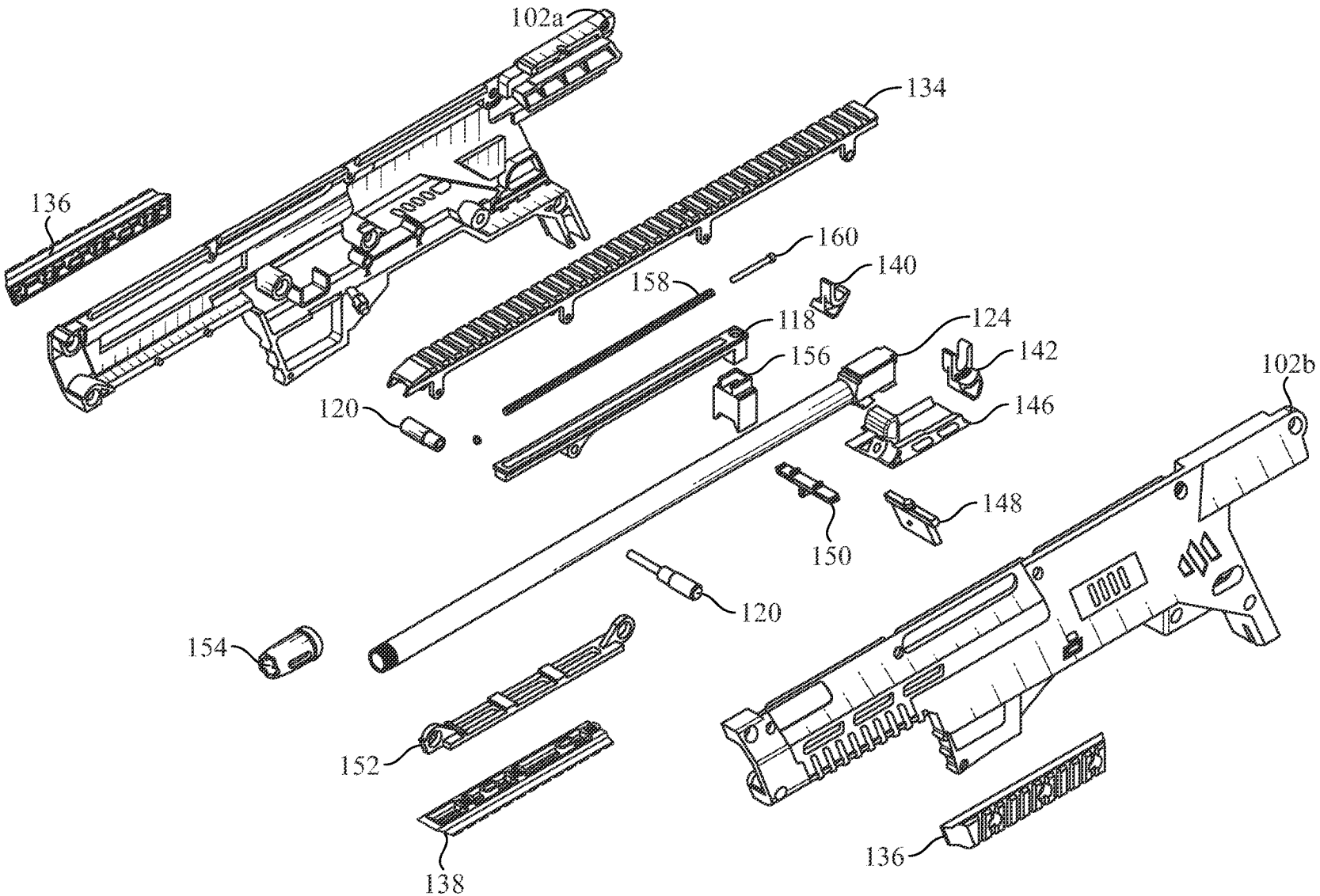
FIG. 3 illustrates an exploded view of a portion of a pistol conversion kit according to some variations described herein.

Referring to FIG. 3, a pistol conversion kit may include a chassis incorporating a two-part complimentary chassis design having a first chassis half 102*a* secured to a second chassis half 102*b*, and a variety of components and assemblies disposed therein and interacting therewith. A charging handle assembly may be disposed within the first chassis half 102*a* secured to the second chassis half 102*b* and may include a charging handle arm 118 affixed to a fork 156 constructed and arranged to mechanically engage with a slide of a pistol. The charging assembly may include a biasing mechanism 158 and spring pin 160 constructed and arranged to bias the charging handle arm 118 and fork 156 away from a pistol 200. At least one charging handle 120 may be connected to the charging handle arm 118 such that a user may pull the at least one charging handle 120 thereby pushing the charging handle arm 118 and fork 156 rearward towards the slide of a pistol. In this way, the charging handle assembly may be used to pull the slide of a pistol back thereby arming the pistol when seated within the pistol conversion kit. The pistol conversion kit may further include at least one slide guide 140, and in some cases, a second slide guide 142 integrated within the chassis to assist in guiding slide travel and reducing recoil during pistol discharge. According to some variations, the pistol conversion kit may incorporate a push button thumb safety 150 constructed and arranged to prevent trigger linkage arm or trigger movement when the thumb safety 150 is engaged. According to some variations, the pistol conversion kit may include a trigger guide 146.

The pistol conversion kit may further include a rear door lock assembly 148 constructed and arranged to lock gun door into a locked position such that the pistol is secured within the chassis.

The pistol conversion kit 100 may include at least one rail disposed thereon and may include a top rail 134, a first side rail 136 or second side rail 136, and bottom rail 138. The pistol conversion kit may further include at least one modular lock pistol rail interface system 152.

Figure 4:
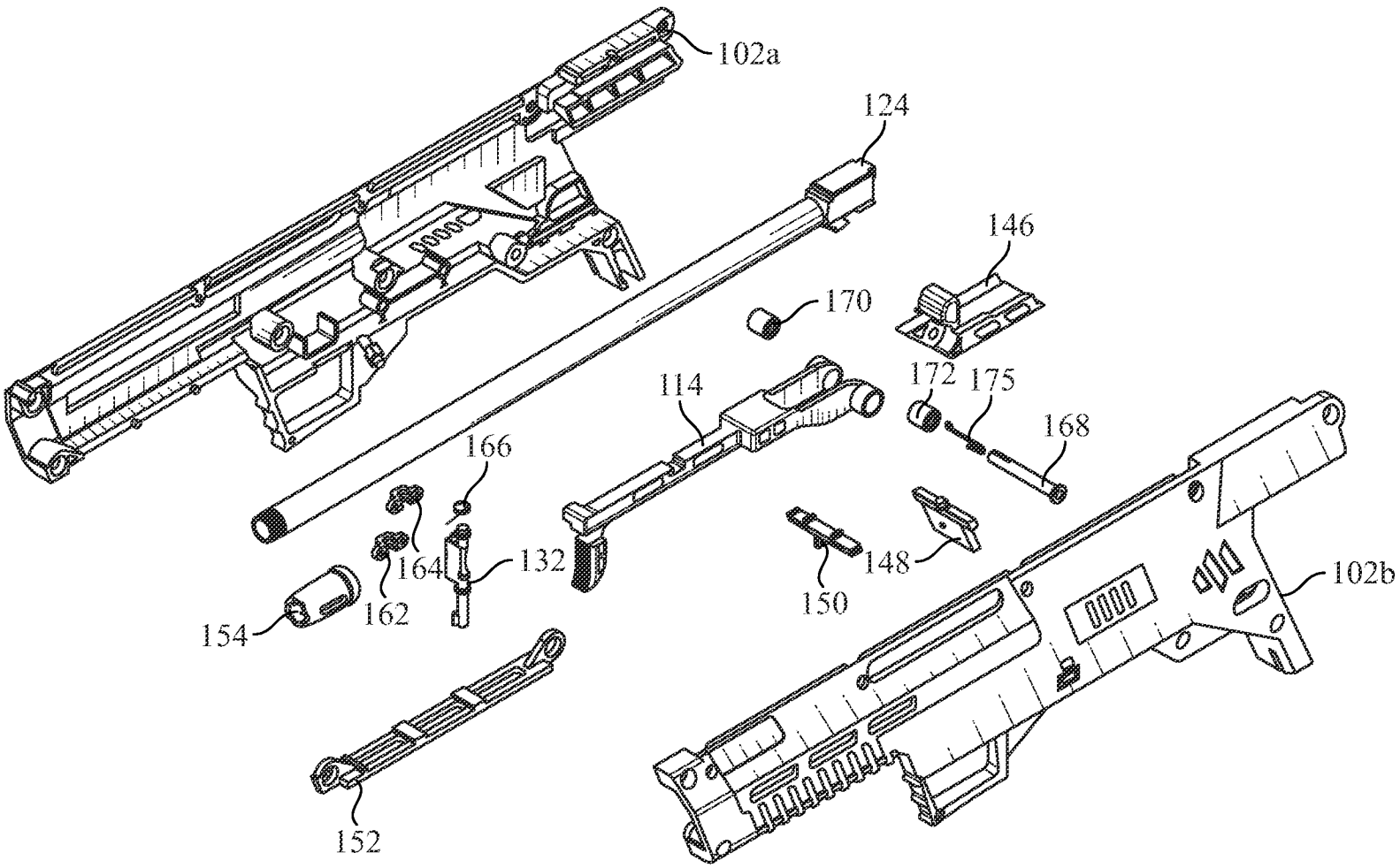
FIG. 4 illustrates an exploded view of a portion of a pistol conversion kit according to some variations described herein.

FIG. 4 depicts an exploded view of a portion of a pistol conversion kit incorporating a two-part complimentary chassis design having a first chassis half 102*a* secured to a second chassis half 102*b*, and a variety of components and assemblies disposed therein and interacting therewith. A trigger assembly may be disposed within the first chassis half 102*a* secured by the second chassis half 102*b* and may include a trigger assembly including a trigger hingedly attached to and in operable communication with a trigger linkage arm 114 connected to a trigger pin 168 constructed and arranged to be in mechanical communication with a pistol trigger of a pistol. The trigger linkage arm 114 may be in mechanical communication with trigger pin 168 wherein the trigger pin 168 is disposed within a portion of the trigger linkage arm and may include at least one trigger pin insert 170, 172, and trigger pin spring 175. According to some variations, the pistol conversion kit may include a trigger guide 146 in operable communication with the trigger linkage arm 114, trigger guide 146 being constructed and arranged to guide the trigger assembly within the two-part complimentary chassis design.

A barrel safety assembly may include a barrel safety assembly may include a barrel safety 132, a torsion spring 166, and one or more barrel safety clips 162, 164 wherein the barrel safety assembly is constructed and arranged to rotate the barrel safety 132 via the torsion spring 166 thereby locking the trigger in place and prevent squeezing of the trigger unless the extension barrel is passed through at least a portion of the barrel safety assembly.

The pistol conversion kit may further include at least one modular lock pistol rail interface systems 152 affixed to the first chassis half 102*a* secured to the second chassis half 102*b*. The pistol conversion kit may further include extension barrel flash hider 154 disposed on the extension barrel 124.

Figure 5:
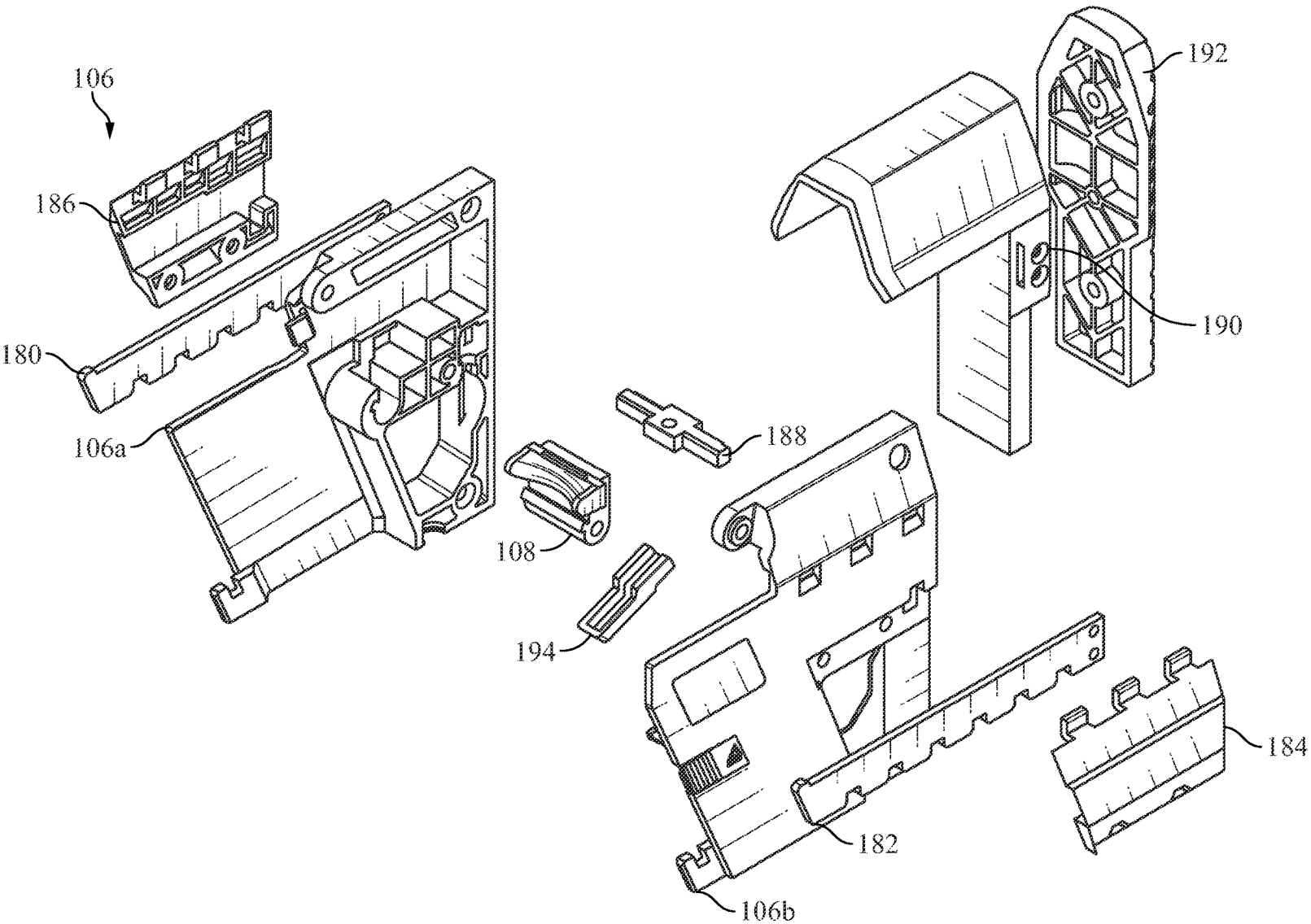
FIG. 5 illustrates an exploded view of a portion of a pistol conversion kit according to some variations described herein.

FIG. 5 illustrates an exploded view of a portion of a pistol conversion kit including a gun door 106 having a two-part complimentary design including a first gun door half 106*a* attachable to a second gun door half 106*b*. The gun door 106 may include at least one stock rail 180, 182, and at least one rail cover 184, 186. The gun door 106 may include a stock adjustment assembly including a stock adjustment lever 194, stock adjustment lock 188, and beavertail lock 108. The stock adjustment assembly may be constructed and arranged for slidably engaging the chassis and being slidably locked thereon such that a user may adjust gun door length or extension from the chassis. The gun door 106 may further include a stock plate 190 and stock pad 192 constructed and arranged for comfortably seating the gun door 106 against a user's shoulder or cheek.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, a pistol conversion kit for converting a pistol into a bull-pup rifle configuration may include an extension barrel constructed and arranged to connect to a muzzle of a pistol; a chassis defining a compartment constructed and arranged to seat the pistol and extension barrel therein, the chassis further including an integrated handle and trigger guard; a gun door hingedly or slidably attached to the chassis, the gun door being constructed and arranged to secure a pistol and extension barrel within the compartment; a trigger assembly at least partially disposed within the compartment and being in operable communication with a pistol trigger; a charging handle assembly at least partially disposed within the compartment and being in operable communication with a pistol slide; a barrel safety assembly at least partially disposed within the compartment and being in operable communication with the extension barrel, the barrel safety assembly being constructed and arranged to optionally interfere with the trigger assembly.

Variation 2 may include a pistol conversion kit for converting a pistol into a bull-pup rifle configuration as in variation 1, wherein the chassis includes a first chassis half and a second chassis half, the first chassis half and second chassis half being complimentary in design and being constructed and arranged to attach to one another to define the compartment.

Variation 3 may include a pistol conversion kit for converting a pistol into a bull-pup rifle configuration as in any of variations 1 through 2, wherein the trigger assembly includes a trigger hingedly attached to and in operable communication with a trigger linkage arm rotatably connected to a trigger pin constructed and arranged to be in mechanical communication with a pistol trigger of the pistol.

Variation 4 may include a pistol conversion kit for converting a pistol into a bull-pup rifle configuration as in any of variations 1 through 3, wherein the trigger assembly is constructed and arranged to translate movement of the trigger to the pistol trigger.

Variation 5 may include a pistol conversion kit for converting a pistol into a bull-pup rifle configuration as in any of variations 1 through 4, wherein the charging handle assembly includes at least one charging handle attached to charging handle arm affixed to a fork, the fork being constructed and arranged to mechanically engage with a slide of a pistol.

Variation 6 may include a pistol conversion kit for converting a pistol into a bull-pup rifle configuration as in any of variations 1 through 5, wherein the chassis defines a charging handle channel, the at least one charging handle being at least partially disposed within the charging handle channel and translatable therein.

Variation 7 may include a pistol conversion kit for converting a pistol into a bull-pup rifle configuration as in any of variations 1 through 6, wherein the charging handle assembly is constructed and arranged to translate movement of the charging handle to movement of the slide of the pistol.

Variation 8 may include a pistol conversion kit for converting a pistol into a bull-pup rifle configuration as in any of variations 1 through 7, wherein the extension barrel is about sixteen inches in length.

Variation 9 may include a pistol conversion kit for converting a pistol into a bull-pup rifle configuration as in any of variations 1 through 8, wherein the gun door further includes a two-part complimentary design including a first gun door half attachable to a second gun door half.

Variation 10 may include a pistol conversion kit for converting a pistol into a bull-pup rifle configuration as in any of variations 1 through 9, wherein the gun door further includes a stock adjustment assembly including a stock adjustment lever, stock adjustment lock, and beavertail lock.

Variation 11 may include a pistol conversion kit for converting a pistol into a bull-pup rifle configuration as in any of variations 1 through 10, wherein the stock adjustment assembly it is constructed and arranged for slidably engaging the chassis and being slidably locked thereon such that a user may adjust at least one of gun door length or extension from the chassis.

Variation 12 may include a pistol conversion kit for converting a pistol into a bull-pup rifle configuration as in any of variations 1 through 11, wherein the barrel safety assembly includes a torsion spring, a linkage stop, and barrel safety pivotably disposed within the chassis, the barrel safety assembly being constructed and arranged to bias the barrel safety towards the trigger assembly via the linkage stop and lock at least a portion of the trigger assembly in place.

Variation 13 may include a pistol conversion kit for converting a pistol into a bull-pup rifle configuration as in any of variations 1 through 12, wherein the barrel safety includes a base including a first boss; the trigger linkage arm further includes a second boss complementary to the first boss; and the first boss and second boss being constructed and arrange to mechanically engage such that when no extension barrel is present within the chassis, the trigger is prevented from movement.

Variation 14 may include a pistol conversion kit for converting a pistol into a bull-pup rifle configuration as in any of variations 1 through 13, further including a magazine release button integrated with the chassis and being constructed and arranged to depress a pistol magazine release button.

According to variation 15, a pistol conversion kit for converting a pistol into a bull-pup rifle configuration may include an extension barrel constructed and arranged to connect to a muzzle of a pistol; a chassis including an integrated handle and trigger guard, the chassis defining a compartment constructed and arranged to seat the pistol and extension barrel therein, the chassis further including an integrated handle and trigger guard; a gun door hingedly or slidably attached to the chassis, the gun door being constructed and arranged to secure a pistol and extension barrel within the compartment; a trigger assembly at least partially disposed within the compartment and being in operable communication with a pistol trigger, the trigger assembly including a trigger hingedly attached to and in operable communication with a trigger linkage arm rotatably connected to a trigger pin constructed and arranged to be in mechanical communication with the pistol trigger of the pistol and wherein the trigger linkage arm includes a second boss; a charging handle assembly at least partially disposed within the compartment and being in operable communication with a pistol slide; and a barrel safety assembly at least partially disposed within the compartment and being in operable communication with the extension barrel, the barrel safety assembly being constructed and arranged to optionally interfere with the trigger assembly via a first boss mechanically engaging with the second boss.

Variation 16 may include a pistol conversion kit for converting a pistol into a bull-pup rifle configuration as in variation 15, wherein the chassis includes a two-part complimentary design including a first chassis half and a second chassis half.

Variation 17 may include a pistol conversion kit for converting a pistol into a bull-pup rifle configuration as in any of variations 15 through 16, further including a flash hider.

Variation 18 may include a pistol conversion kit for converting a pistol into a bull-pup rifle configuration as in any of variations 15 through 17, wherein the chassis is constructed and arranged to securely seat a pistol behind the integrated handle and trigger guard.

Variation 19 may include a pistol conversion kit for converting a pistol into a bull-pup rifle configuration as in any of variations 15 through 8, further including at least one modular lock pistol rail interface system disposed on an exterior surface of the chassis.

According to variation 20, a pistol conversion kit for converting a pistol into a bull-pup rifle configuration may include an extension barrel constructed and arranged to connect to a muzzle of a pistol; a flash hider connected to the extension barrel; a chassis including an integrated handle and trigger guard, the chassis including a two-part complimentary design including a first chassis half attachable to a second chassis half, the chassis defining a compartment constructed and arranged to seat the pistol and extension barrel therein, the chassis further including an integrated handle and trigger guard; a gun door hingedly or slidably attached to the chassis, the gun door being constructed and arranged to secure a pistol and extension barrel within the compartment, the gun door including a second two-part complimentary design including a first gun door half attachable to a second gun door half; a trigger assembly at least partially disposed within the compartment and being in operable communication with a pistol trigger, the trigger assembly including a trigger hingedly attached to and in operable communication with a trigger linkage arm rotatably connected to a trigger pin constructed and arranged to be in mechanical communication with the pistol trigger of the pistol and wherein the trigger linkage arm includes a second boss; a charging handle assembly at least partially disposed within the compartment and being in operable communication with a pistol slide; and a barrel safety assembly at least partially disposed within the compartment and being in operable communication with the extension barrel, the barrel safety assembly being constructed and arranged to optionally interfere with the trigger assembly via a first boss mechanically engaging with the second boss.

Many different embodiments have been disclosed herein, in connection with the above description and the drawing. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for anyone of the elements in the claims below or that a single element can be substituted for two or more elements in a claim. Although elements can be described above as acting in certain combinations, and even initially claimed as such, it is to be expressly understood that one or more elements from a claimed combination can, in some cases, be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible considering the above teachings without departing from the following claims.

What is claimed is:

1. A pistol conversion kit for converting a pistol into a bull-pup rifle configuration, comprising:

an extension barrel constructed and arranged to replace the barrel of the pistol;

a chassis defining a compartment constructed and arranged to seat the pistol and extension barrel therein, the chassis further comprising an integrated handle and trigger guard;

a gun door attached to the chassis, the gun door being constructed and arranged to secure a pistol and extension barrel within the compartment;

a trigger assembly at least partially disposed within the compartment and being in operable communication with a pistol trigger;

a charging handle assembly at least partially disposed within the compartment and being in operable communication with a pistol slide; and a barrel safety assembly at least partially disposed within the compartment and being in operable communication with the extension barrel, the barrel safety assembly being constructed and arranged to optionally interfere with the trigger assembly.

2. A pistol conversion kit for converting a pistol into a bull-pup rifle configuration as in claim 1, wherein the chassis comprises a first chassis half and a second chassis half, the first chassis half and second chassis half being complimentary in design and being constructed and arranged to attach to one another to define the compartment.

3. A pistol conversion kit for converting a pistol into a bull-pup rifle configuration as in claim 1, wherein the trigger assembly comprises a trigger hingedly attached to and in operable communication with a trigger linkage arm rotatably connected to a trigger pin constructed and arranged to be in mechanical communication with a pistol trigger of the pistol.

4. A pistol conversion kit for converting a pistol into a bull-pup rifle configuration as in claim 3, wherein the trigger assembly is constructed and arranged to translate movement of the trigger to the pistol trigger.

5. A pistol conversion kit for converting a pistol into a bull-pup rifle configuration as in claim 1, wherein the charging handle assembly comprises at least one charging handle attached to charging handle arm affixed to a fork, the fork being constructed and arranged to mechanically engage with a slide of a pistol.

6. A pistol conversion kit for converting a pistol into a bull-pup rifle configuration as in claim 5, wherein the chassis defines a charging handle channel, the at least one charging handle being at least partially disposed within the charging handle channel and translatable therein.

7. A pistol conversion kit for converting a pistol into a bull-pup rifle configuration as in claim 6, wherein the charging handle assembly is constructed and arranged to translate movement of the charging handle to movement of the slide of the pistol.

8. A pistol conversion kit for converting a pistol into a bull-pup rifle configuration as in claim 1, wherein the extension barrel is about sixteen inches in length.

9. A pistol conversion kit for converting a pistol into a bull-pup rifle configuration as in claim 1, wherein the gun door further comprises a two-part complimentary design including a first gun door half attachable to a second gun door half.

10. A pistol conversion kit for converting a pistol into a bull-pup rifle configuration as in claim 1, wherein the gun door further comprises a stock adjustment assembly including a stock adjustment lever, stock adjustment lock, and beavertail lock.

11. A pistol conversion kit for converting a pistol into a bull-pup rifle configuration as in claim 10, wherein the stock adjustment assembly it is constructed and arranged for slidably engaging the chassis and being slidably locked thereon such that a user may adjust at least one of gun door length or extension from the chassis.

12. A pistol conversion kit for converting a pistol into a bull-pup rifle configuration as in claim 1, wherein the barrel safety assembly comprises a torsion spring, a linkage stop, and barrel safety pivotably disposed within the chassis, the barrel safety assembly being constructed and arranged to bias the barrel safety towards the trigger assembly via the linkage stop and lock at least a portion of the trigger assembly in place.

13. A pistol conversion kit for converting a pistol into a bull-pup rifle configuration as in claim 12, wherein:

the barrel safety comprises a base comprising a first boss;

the trigger linkage arm further comprises a second boss complementary to the first boss; and the first boss and second boss being constructed and arrange to mechanically engage such that when no extension barrel is present within the chassis, the trigger is prevented from movement.

14. A pistol conversion kit for converting a pistol into a bull-pup rifle configuration as in claim 1, further comprising a magazine release button integrated with the chassis and being constructed and arranged to depress a pistol magazine release button.

15. A pistol conversion kit for converting a pistol into a bull-pup rifle configuration, comprising:

an extension barrel constructed and arranged to connect to a muzzle of a pistol;

a chassis comprising an integrated handle and trigger guard, the chassis defining a compartment constructed and arranged to seat the pistol and extension barrel therein, the chassis further comprising an integrated handle and trigger guard;

a gun door hingedly attached to the chassis, the gun door being constructed and arranged to secure a pistol and extension barrel within the compartment;

a trigger assembly at least partially disposed within the compartment and being in operable communication with a pistol trigger, the trigger assembly comprising a trigger hingedly attached to and in operable communication with a trigger linkage arm rotatably connected to a trigger pin constructed and arranged to be in mechanical communication with the pistol trigger of the pistol and wherein the trigger linkage arm comprises a second boss;

a charging handle assembly at least partially disposed within the compartment and being in operable communication with a pistol slide;

a barrel safety assembly at least partially disposed within the compartment and being in operable communication with the extension barrel, the barrel safety assembly being constructed and arranged to optionally interfere with the trigger assembly via a first boss mechanically engaging with the second boss.

16. A pistol conversion kit for converting a pistol into a bull-pup rifle configuration as in claim 15, wherein the chassis comprises a two-part complimentary design including a first chassis half and a second chassis half.

17. A pistol conversion kit for converting a pistol into a bull-pup rifle configuration as in claim 15, further comprising a flash hider.

18. A pistol conversion kit for converting a pistol into a bull-pup rifle configuration as in claim 15, wherein the chassis is constructed and arranged to securely seat a pistol behind the integrated handle and trigger guard.

19. A pistol conversion kit for converting a pistol into a bull-pup rifle configuration as in claim 15, further comprising at least one modular lock pistol rail interface system disposed on an exterior surface of the chassis.

20. A pistol conversion kit for converting a pistol into a bull-pup rifle configuration, comprising:

an extension barrel constructed and arranged to replace the barrel of a pistol;

a flash hider connected to the extension barrel;

a chassis comprising an integrated handle and trigger guard, the chassis comprising a two-part complimentary design including a first chassis half attachable to a second chassis half, the chassis defining a compartment constructed and arranged to seat the pistol and extension barrel therein, the chassis further comprising an integrated handle and trigger guard;

a gun door hingedly attached to the chassis, the gun door being constructed and arranged to secure a pistol and extension barrel within the compartment, the gun door comprising a second two-part complimentary design including a first gun door half attachable to a second gun door half;

a trigger assembly at least partially disposed within the compartment and being in operable communication with a pistol trigger, the trigger assembly comprising a trigger hingedly attached to and in operable communication with a trigger linkage arm rotatably connected to a trigger pin constructed and arranged to be in mechanical communication with the pistol trigger of the pistol and wherein the trigger linkage arm comprises a second boss;

a charging handle assembly at least partially disposed within the compartment and being in operable communication with a pistol slide; and a barrel safety assembly at least partially disposed within the compartment and being in operable communication with the extension barrel, the barrel safety assembly being constructed and arranged to optionally interfere with the trigger assembly via a first boss mechanically engaging with the second boss.

* * * * *